US005228622A

United States Patent [19]

Murphy et al.

[11] Patent Number: 5,228,622

[45] Date of Patent: Jul. 20, 1993

[54] SPRAYING SYSTEM HAVING PRESSURE SAFETY LIMITS

[75] Inventors: Edward P. Murphy, Blaine; Albert W. Lubenow, Inver Grove Heights, both of Minn.

[73] Assignee: Graco Inc., Golden Valley, Minn.

[21] Appl. No.: 901,527

[22] Filed: Jun. 19, 1992

[51] Int. Cl.[5] ..... B05B 12/00

[52] U.S. Cl. ..... 239/126; 239/127; 251/63; 137/885

[58] Field of Search ..... 239/126, 124, 127, 533.1, 239/569, 583; 251/63, 63.5, 324; 137/885, 872

[56] References Cited

U.S. PATENT DOCUMENTS 2,578,102 12/1951 Stephenson et al. ..... 239/124
2,687,739 8/1954 Shelburne et al. ..... 239/127
2,753,664 7/1956 Garver .
3,322,350 5/1967 Heinicke et al. .
4,176,793 12/1979 Heinrich .
4,238,073 12/1980 Liska ..... 239/127
4,569,480 2/1986 Levey ..... 239/127
4,588,318 5/1986 O'Brien et al. .
4,801,088 1/1989 Baker .
4,850,536 7/1989 Teranishi et al. .

*Primary Examiner*—Andres Kashnikow
*Assistant Examiner*—Karen B. Merritt
*Attorney, Agent, or Firm*—Palmatier, Sjoquist & Helget

[57] ABSTRACT

A control system for a mechanically-driven liquid pump coupled to an air spray gun wherein the control system includes an air pressure monitor to detect air flow to the spray gun and an electrically-operated solenoid valve to relieve liquid pressure in the spray gun liquid delivery line when the spray gun is inoperable, and to control a clutch mechanism to drive the pump when the spray gun is operable or when the pump is being primed.

17 Claims, 3 Drawing Sheets

SPRAYING SYSTEM HAVING PRESSURE SAFETY LIMITS

BACKGROUND OF THE INVENTION

The present invention relates to spraying systems, particularly systems for spraying coating materials under relatively high material pressure conditions. The invention is particularly adapted to portable spraying systems wherein a gasoline engine or equivalent drives a hydraulic pump, and the pump delivers the spraying materials to a spray gun connected to it by a section of elongated hose.

Advances in hydraulic pump designs have enabled spraying systems to be developed for delivering coating materials under relatively high hydraulic pressures. It is not uncommon for such systems to be pressurized coating materials to hydraulic pressures in the range of 1,000–4,000 pounds per square inch (psi), for under such highly pressurized conditions it is usually possible to obtain a higher quality spray finish. On the other hand, coating materials themselves have been changed to encompass a wide range of viscosities, wherein high viscosity coating materials require extremely high hydraulic pressures for atomization and delivery to a coating surface. The present invention is particularly adapted for spraying heavily viscous, textured materials, but the principles of the invention are applicable to a wide range of coating materials. Such materials are usually sprayed under hydraulic pressure conditions which are less than 1,000 psi, and greater than approximately 100 psi. Portable systems for spraying materials of this type may be conveniently driven by relatively small gasoline engines which are mechanically linked to hydraulic pumps, and wherein the pumps are linked to a spray gun by hoses. In many cases such materials may be sprayed using air spray techniques, wherein pressurized air is also delivered to the spray gun to either atomize the coating materials as they are emitted from the spray gun, or assist in the atomization of the coating materials, which are atomized both under the influence of hydraulic pressure and air pressure. Systems of this type require a power source for developing the hydraulic pressure required, and also a source of compressed air for providing a supply of pressurized air, but the respective pressure ranges are much more moderate than pressures required in systems where hydraulic pressure alone is utilized.

Any spraying system operating under even moderate pressure conditions requires certain safety features for protection of the system operator. In particular, the operator must be protected from inadvertent exposure and contact with the materials emitted from the spray gun, particularly in close proximity to the spray tip. The system should provide safeguards to minimize the operator's potential for injury from highly pressurized equipment and materials.

SUMMARY OF THE INVENTION

The present invention provides a spraying system for applying viscous coating materials under moderate to high hydraulic and air pressure conditions, and provides for relief from extreme pressures which might build up as a result of equipment malfunctions. Further, the present invention automatically relieves pressure buildup within the system whenever actual spraying operations are discontinued. The invention is used with a source of air pressure for delivering pressurized air to a spray gun, and a mechanically-driven hydraulic pump for delivering spray material to the spray gun under moderate to high pressure. The invention includes pressure sensors for monitoring the system operation to detect potential malfunctions and nonuse of the system, and a material control valve for unloading hydraulic pressures in hoses during periods of nonuse of the system, and includes a system controller for converting various detected pressure conditions to actuation signals for the material control valve.

It is a principal object and feature of the invention to provide a portable material spray system having safety pressure relief features.

It is another object of the invention to provide a portable material spray system in which the material spray applicator may be intermittently used without reduction in the quality of the spray coating.

It is a further object of the present invention to provide a portable spray system wherein the material delivery may be modified for a priming cycle and a spraying cycle.

The foregoing and other objects and advantages of the system will become apparent from the following specification and claims, and with reference to the appended drawings.

DESCRIPTION OF THE PREFERRED EMBODIMENT

Figure 1:
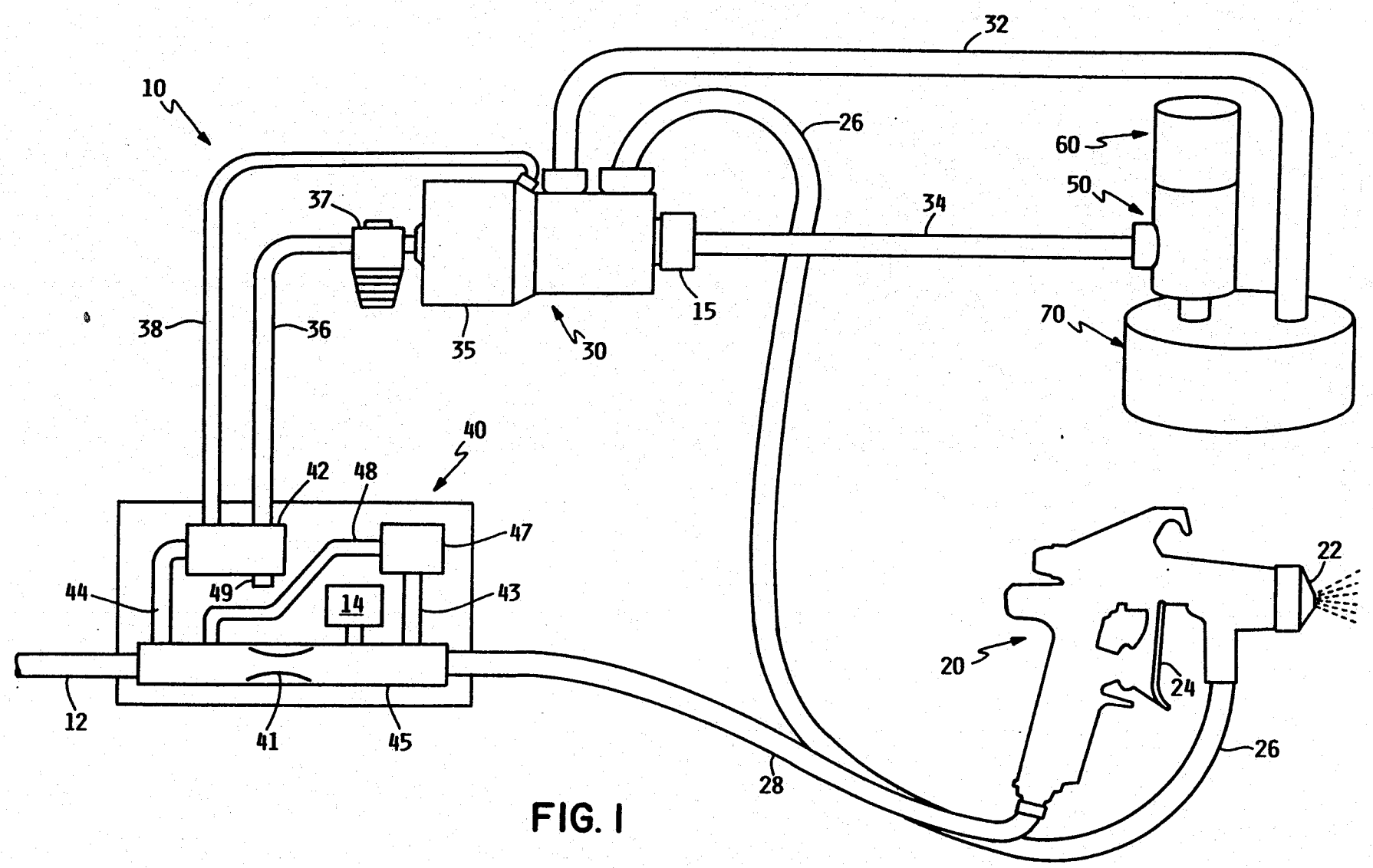
FIG. 1 shows a pictorial diagram of the present invention.

FIG. 1 shows a pictorial view of the system, wherein all of the electrical circuits of the system have been removed for clarity. Spray system 10 includes a spray gun 20 for spraying atomized material to a suitable article via a spray nozzle 22. Spray gun 20 has a trigger 24 for activating the spray, and has a material delivery hose 26 for delivering the spray material to the spray gun. An air hose 28 is also connected to spray gun 20, for delivering a supply of pressurized air to the spray gun.

The material delivery hose 26 is connected to a material control valve 30. A recirculation hose 32 is also connected to control valve 30, and is coupled at its other end to a material container 70. Material control valve 30 is also connected via a delivery hose 34 to pump 50, which delivers the material to be sprayed to the material control valve 30. Pump 50 has an intake in material container 70, which serves as a supply of spray coating material. Pump 50 is mechanically driven by a pump motor drive 60, which may be an electric motor drive system, or a gasoline engine motor drive system.

Material control valve 30 has an interconnected air cylinder 35 which receives pressurized air from either of two hoses 36 or 38; a pressure regulator 37 is inserted in series flow relation to hose 36.

Hoses 36 and 38 are connected to a four-way valve 42 in system controller 40. Valve 42 has an air inlet 44, and an exhaust air outlet 49. Line 48 is coupled to a differential pressure switch 47, which is further coupled to a manifold 45 via a passage 43. Manifold 45 receives a source of pressurized air via air inlet hose 12, and couples this pressurized air to air hose 28. A venturi 41 is proximately centrally located within manifold 45 for purposes to be hereinafter described. A pressure switch 14 is also coupled to manifold 45 to detect the air pressure within the manifold 45, downstream from venturi 41.

In overall operation, a source of pressurized air is utilized for delivering pressurized air via air inlet hose 12 to the system. A typical source of pressurized air might be a 10 horsepower air compressor, capable of delivering air under pressures in the range of 0–100 psi, at air volumes up to 30 standard cubic feet per minute (scfm). Pressurized air is delivered via system controller 40 and hose 28 to spray gun 20 for purposes of assisting in the atomization of the materials being sprayed. Pressurized air is also delivered to air cylinder 35 in material control valve 30 via hoses 36 and 38, for driving the control valve between either of two material flow positions. The pump 50 is typically a hydraulic reciprocation pump which is mechanically linked to a gasoline engine 60. One form of gasoline engine which has been successfully used in connection with the present invention is a 4-cycle, 5 horsepower gasoline engine manufactured by the Honda Company. This gasoline engine when coupled to a suitable pump 50 will deliver material at a flow volume of three gallons per minute, under pressure conditions of 0–1,000 psi. Additionally, the gasoline engine has an electrical generating capacity from its internal flywheel magneto to enable it to deliver approximately 50 watts of electrical energy at a voltage range of 6–16 volts AC. The electrical power from the gasoline engine is suitably used as the electrical power source required by the circuits of the present invention.

The 4-way valve 42 may be derived from any of a number of commercially-available components, as for example, a valve manufactured by Mac Valves, Inc. of Wixon, Mich., under Part No. 45A-AA1-DAPA-1BA. The pressure switch 14 is also commercially available, as for example, Part No. MSPS-EE1OOSS, manufactured by Barksdale Company of Los Angeles, Calif. Differential pressure switch 47 may be obtained from World Magnetics Corp. of Traverse City, Mich., under Part No. PSF101R. The air pressure regulator 37 is commonly available under various commercial designations. The venturi 41 may be formed in manifold 45 by means of reducing the diameter of a portion of the air passage through manifold 45. For example, manifold 45 may typically have a ⅜ inch passage therethrough, with a venturi section constructed by reducing the diameter of this passage to ½ the passthrough diameter, for a distance of about 20 percent of the length of the manifold 45.

Figure 2A:
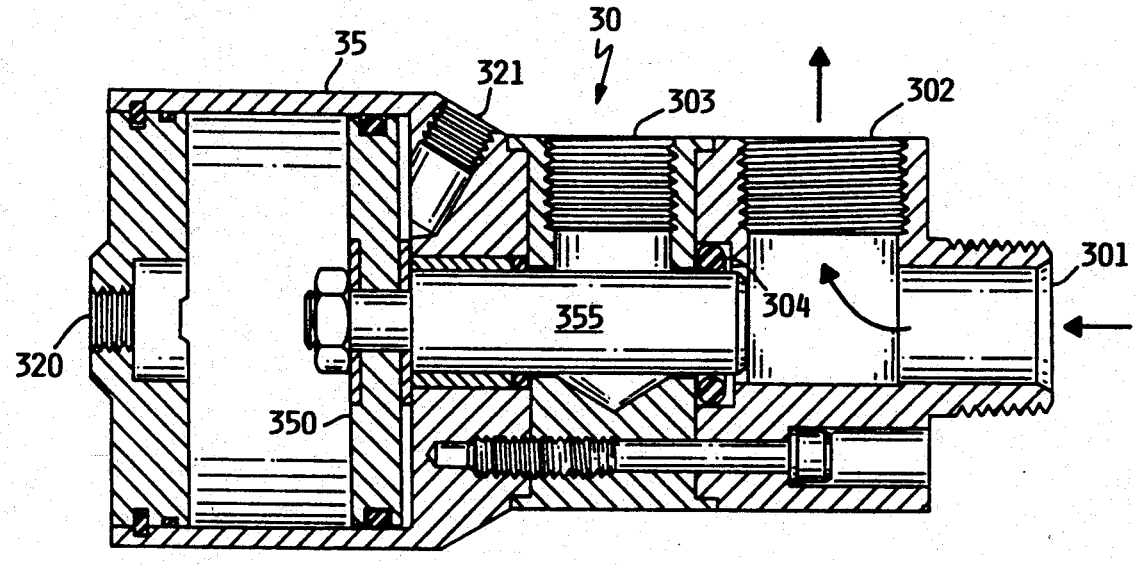
FIG. 2A shows a cross-sectional view of the material control valve in a first position.

FIG. 2A shows material control valve 30 in a first actuation position, wherein a flow-through passage is created between inlet port 301 and outlet port 302. This corresponds to a flow-through connection from hose 34 to hose 26, connecting pump 50 to spray gun 20. In this position, the piston 350 in air cylinder 35 is in its forwardmost position, forcing actuator rod 355 into blocking relationship in port 304. Therefore, outlet port 303 is closed, and no material will flow through recirculating hose 32. Air cylinder 35 has an air inlet/outlet port 320 and an air inlet/outlet port 321. In the position illustrated in FIG. 2A, pressurized air is admitted into port 320 via air hose 36, and port 321 is relieved to atmosphere via hose 38, as will be hereinafter described. When actuator rod 355 is in its forwardmost position as shown in FIG. 2A, it completely fills the opening of port 304, thereby preventing the buildup of any material in port 304.

Figure 2B:
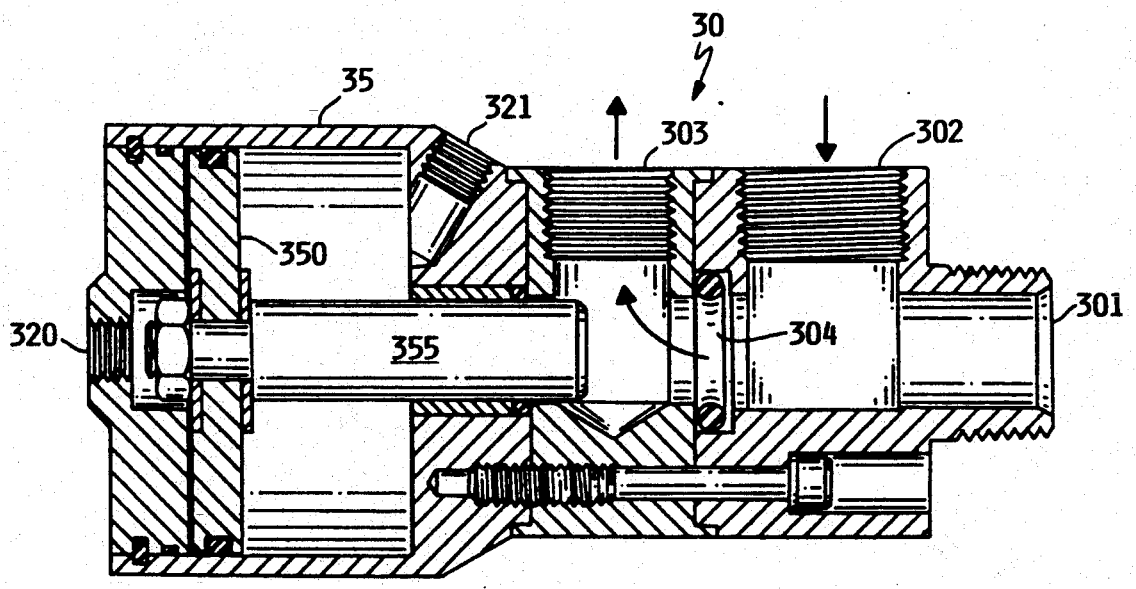
FIG. 2B shows a cross-sectional view of the material control valve in a second position.

FIG. 2B shows control valve 30 in its second position, wherein piston 350 is in its rearwardmost position, thereby extracting actuator rod 355 from engagement in port 304. In this position, material flow is permitted into port 302, through port 304 and out through port 303. Therefore, pressurized liquid in hose 26 is permitted to flow rearwardly through control valve 30 into recirculation hose 32, and into material container 70. Inlet port 301 is also open for material flow, which will cause pump 50 to pump liquid back into reservoir 70 via recirculating hose 32. Piston 350 in air cylinder 35 is retracted to its rearmost position by applying pressurized air into port 321, and at the same time exhausting port 320 to atmosphere. The respective valve positions shown in FIGS. 2A and 2B are therefore controllable by 4-way valve 42 in controller 40.

Figure 3:
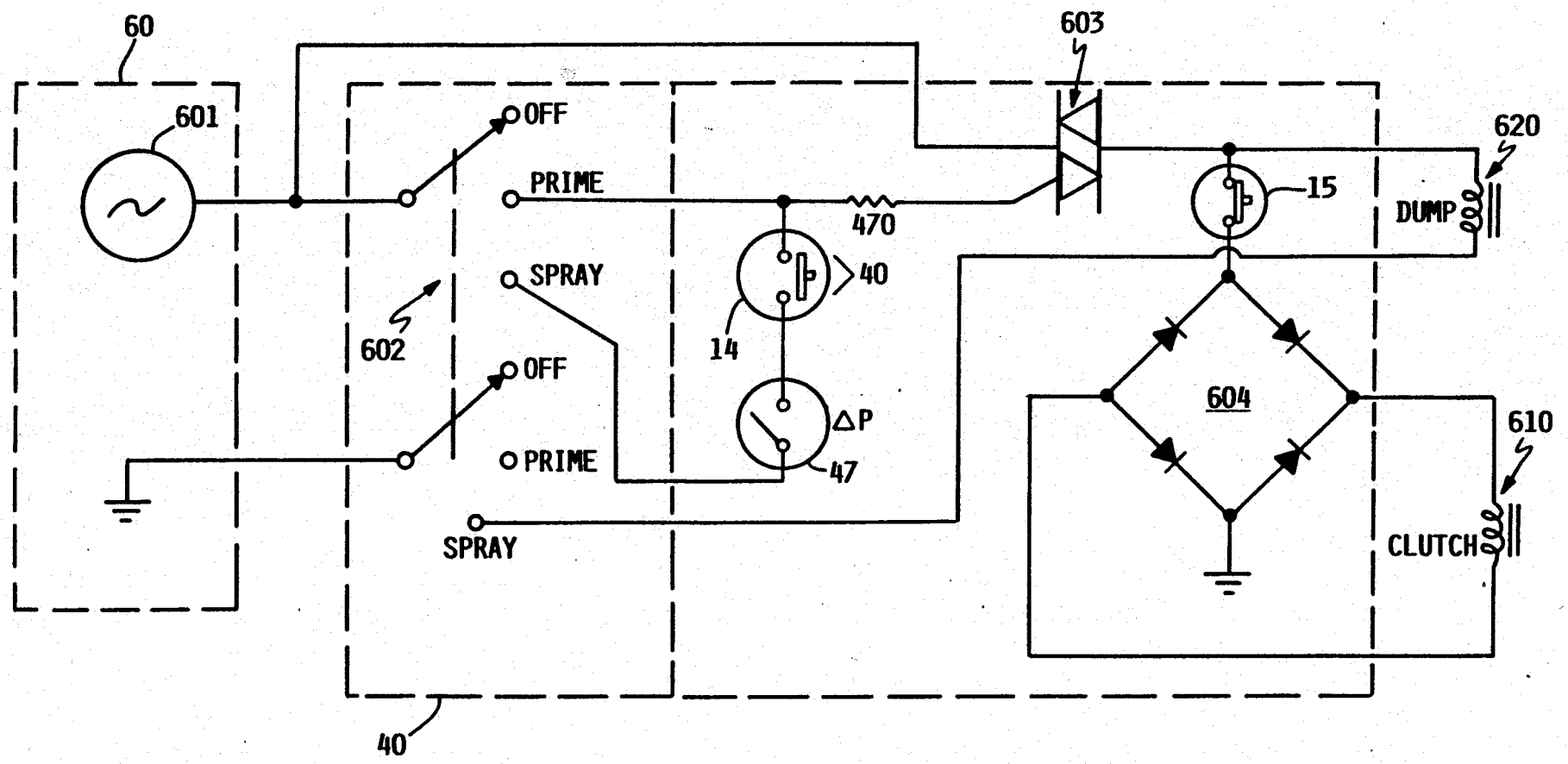
FIG. 3 shows an electrical diagram of the system.

FIG. 3 shows an electrical schematic of the important features of the invention. The electric circuitry within gasoline engine 60 includes a magneto 601, which generates the necessary electrical power for operating all of the remaining electrical circuits associated with the invention. The circuit ground is also provided by the gasoline engine 60, and electrical connections from the magneto 601 and circuit ground are connected to system controller 40; specifically to a double pole triple position switch 602. The three positions of this switch are designated "off," "prime," and "spray." In the "off" position, switch 602 disables all electrical power to the system. In the "prime" position, switch 602 connects the electrical voltage from magneto 601 to a semiconductor triac switch 603, causing the triac switch to close. When the triac switch 603 closes, the magneto-generated power is delivered to pressure switch 15, which is a normally-closed switch, connected to a full wave bridge rectifier 604, which delivers a DC output voltage to a clutch solenoid 610. Pressure switch 15 is preset to open at a predetermined liquid pressure; in the preferred embodiment this liquid pressure setting is 1,000 psi. When pressure switch 15 opens the power to clutch solenoid 610 is disabled and the liquid pump is thereby shut off. The magneto-generated power is also delivered to a dump valve solenoid 620; however, the dump valve solenoid 620 is also electrically connected to the "spray" position of switch 602, which is an open circuit connection when the switch 602 is in the "prime" position. Therefore, when switch 602 is in the "prime" position electrical power is delivered to the clutch solenoid 610. Clutch solenoid 610 activates an electromagnetic clutch which mechanically connects the gasoline engine 60 to the pump 50, and causes the pump 50 to begin its pumping action. Dump valve solenoid 620 is the controlling actuator for 4-way valve 42. When the solenoid is deactivated, as in the "prime" position of switch 602, the 4-way valve 42 is positioned so as to deliver pressurized air to inlet port 321 of air cylinder 35, thereby causing piston 350 to retract to its rearward position. This provides a flow path through the material control valve 30 coupling material from pump 34 directly to recirculation hose 32, and back to reservoir 70. It is therefore apparent that when switch 602 is in the "prime" position, the pump 50 is actuated to cause the flow of material through a recirculation loop including reservoir 30, and therefore able to prime the system with the fluid in the liquid delivery hoses.

When switch 602 is switched to the "spray" position, the magneto 601 power is connected to a series string of two pressure-related switches 14 and 47, to be hereinafter described. Assuming both switches to be in the closed position, the electrical power is again delivered to trigger triac 603, and to provide the electrical power to energize clutch solenoid 610. Electrical power is also delivered to dump solenoid 620, which is connected to ground via the switch 602, and therefore dump solenoid 620 becomes activated. The activation of solenoid 620 causes 4-way valve 42 to toggle to its second position, thereby reversing the delivery of pressurized air into air cylinder 35. This causes the piston 350 in air cylinder 35 to move forwardly, and actuator rod 355 moves into closure position in port 304, thereby blocking port 303. The liquid material delivered by pump 50 flows into inlet 301 and out port 302, to spray gun 20 via hose 26. Spray gun 20 may then spray the material if the trigger 24 is actuated.

In the foregoing description, it was assumed that the series string of two pressure-related switches 14 and 47 connected to switch 602 were all in the closed position, in order for power to be delivered to activate the dump valve solenoid 620. However, each of these switches may be in either an open or closed position, depending upon certain pressure conditions in the system. For example, differential pressure switch 47 becomes closed upon sensing a differential pressure across manifold 45. The only time a differential pressure can occur across manifold 45 is when pressurized air is passing through manifold 45, and in particular through venturi 41, which causes a downstream pressure drop relative to the upstream pressure value. Pressurized air can only flow through manifold 45 when air delivery demands are being made by spray gun 20, as by the spray gun trigger 24 being actuated. Therefore, differential pressure switch 47 detects the condition when pressurized air is being delivered through spray gun 20, after the spray gun trigger has been actuated.

The remaining switch in the series string is pressure switch 14, which is in the normally open position. The pressure switch 14 contacts are normally open, but become closed whenever the pressure in manifold 45 exceeds a predetermined value. In the preferred embodiment, this predetermined value is approximately 30 psi. Therefore, under operating conditions where the manifold 45 pressure is higher than 30 psi, switch 14 will be in the closed position, and the differential pressure across manifold 45 will control the operation of the system.

In operation, the invention permits the system to safely operate under a variety of conditions. The "prime" condition has previously been described, but several conditions of operation are also permitted under the "spray" position of switch 602. If switch 602 is switched to the "spray" position, the material control valve 30 will not permit pressurized liquid to be delivered to spray gun 20 until the spray gun trigger is actuated. Once the spray gun trigger is actuated the pressurized material is delivered to spray gun 20 until the trigger is deactivated, or until certain pressure conditions deviate outside of predetermined limits. If the spray gun trigger is deactivated, the differential pressure switch immediately opens and deactivates the dump valve solenoid 620. This causes the air cylinder to toggle the material control valve and creates a flow path back to the reservoir 70 via recirculation hose 32. It is important to be noted that liquid pressure buildup in hose 26 is then relieved back to reservoir 70, and clutch solenoid 610 is also deactivated to thereby cause pump 50 to shut off. When the spray gun trigger is reactuated, power is again delivered to the dump solenoid 620 and the clutch solenoid 610, thereby causing the pump to restart and causing the material control valve to deliver the pressurized liquid to the spray gun.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A spraying system operated under pressurized spraying conditions and pressurized liquid delivery conditions, and having a liquid pressure relief feature comprising:

a) a liquid pump having means for delivering pressurized liquid from a reservoir to a delivery hose;

b) an air-actuable valve having an inlet connected to said delivery hose and having a first valve port and return hose coupled to said reservoir, and having a second valve port and hose connectable to a spray gun;

c) a system controller having a manifold with a flow restriction therein, said manifold having an inlet connectable to a source of pressurized air and an outlet connectable to said spray gun; said manifold having first means for sensing pressure drop across said manifold flow restriction, and first means actuable by said first means for sensing, for actuating said air-actuable valve; whereby said valve is positionable to deliver liquid from said delivery hose to said spray gun, or from said spray gun hose to said reservoir; and d) second means for sensing pressure in said manifold, and second means, actuable by said second means for sensing pressure, for actuating said air-actuable valve.

2. The apparatus of claim 1, wherein said first and second means for actuating said air-actuable valve further comprises a solenoid valve.

3. The apparatus of claim 2, further comprising a solenoid-actuated clutch for activating said liquid pump.

4. The apparatus of claim 3, wherein said controller further comprises first switch means for energizing said solenoid-actuated clutch.

5. The apparatus of claim 4, wherein said controller further comprises second switch means for energizing said solenoid-actuated clutch and said solenoid valve.

6. The apparatus of claim 5, wherein said first means for sensing pressure drop further comprises a third switch connected in series with said second switch means.

7. The apparatus of claim 6, wherein said second means for sensing pressure further comprises a fourth switch connected in series with said second switch means.

8. The apparatus of claim 7, further comprising a gasoline engine mechanically coupled to drive said liquid pump, said gasoline engine having means for electrically powering said system controller.

9. The apparatus of claim 8, wherein said second means for sensing pressure further comprises means for activating said fourth switch at a predetermined high pressure and a predetermined low pressure in said manifold.

10. An apparatus for controlling a spraying system having a liquid reservoir, a liquid pressure delivery pump coupled to an air spray gun via a liquid delivery line and a motor drive source mechanically coupled to said pump, comprising:

a) an electrically energizable clutch connected between said motor drive source and said pump;

b) an electrically-energizable valve coupled in the liquid delivery line between said pump and said spray gun, said valve having a first position for passing liquid flow from said pump to said spray gun, and a second position passing liquid flow from said spray gun to said liquid reservoir;

c) means for detecting pressurized air flow to said spray gun; and d) control means, responsive to said means for detecting pressurized air flow to said spray gun, having a first circuit for energizing said valve to said first position when air flow is detected and for energizing said valve to said second position when no air flow is detected, and having a second circuit for energizing said clutch when air flow is detected.

11. The apparatus of claim 10, wherein said control means further comprises an electrical power switch having a first position for energizing said clutch and a second position for applying electrical power to said first and second circuits.

12. The apparatus of claim 11, wherein said means for detecting pressurized air flow further comprises a venturi and means for sensing pressure drop across said venturi.

13. The apparatus of claim 12, wherein said control means further comprises high and low pressure switches connected in series with said electrical power switch.

14. The apparatus of claim 13, wherein said motor drive source further comprises a gasoline engine.

15. The apparatus of claim 14, further comprising means for tapping electrical power from said gasoline engine and applying said power to said electrical power switch.

16. The apparatus of claim 15, wherein said control means further comprises a semiconductor switching circuit electrically connected to said clutch and to said valve.

17. The apparatus of claim 16, wherein said valve further comprises a solenoid-actuable valve.

* * * * *